United States Patent [19]

Tomura et al.

[11] Patent Number: 4,943,504

[45] Date of Patent: Jul. 24, 1990

[54] METHOD FOR DEVELOPING AN ELECTROSTATIC LATENT IMAGE

[75] Inventors: Shinya Tomura, Kanagawa; Sachiko Yasuda, Tokyo, both of Japan

[73] Assignee: Kabushiki Kaisha Toshiba, Kawasaki, Japan

[21] Appl. No.: 303,458

[22] Filed: Jan. 27, 1989

[30] Foreign Application Priority Data

Jan. 29, 1988 [JP] Japan ..... 63-18921

[51] Int. Cl.[5] ..... G03G 13/08

[52] U.S. Cl. ..... 430/102; 430/111; 430/903

[58] Field of Search ..... 430/102, 111, 903

[56] References Cited

U.S. PATENT DOCUMENTS

| | | | |
|---|---|---|---|
| 2,895,847 | 7/1959 | Mayo . | |
| 3,152,012 | 10/1964 | Schaffert . | |
| 3,731,146 | 5/1973 | Bettiga et al. | 317/3 |
| 4,342,822 | 8/1982 | Hosono et al. | 430/97 |
| 4,384,036 | 5/1983 | Sasaki | 430/113 |
| 4,498,756 | 2/1985 | Hosoya et al. | 118/657 |
| 4,521,098 | 6/1985 | Hosoya et al. | 118/651 |
| 4,628,860 | 12/1986 | Hosoya et al. | 118/649 |
| 4,656,965 | 4/1987 | Hosoya et al. | 118/649 |
| 4,833,056 | 5/1989 | Bhateja et al. | 430/903 X |

OTHER PUBLICATIONS

Hosoya et al., "Xerographic Development Using Single-Component Nonmagnetic Toner", IEEE Transactions on Industry Applications, vol. 24, No. 2, pp. 238-243 (1988).

*Primary Examiner*—Roland E. Martin

*Attorney, Agent, or Firm*—Foley & Lardner, Schwartz, Jeffery, Schwaab, Mack, Blumenthal & Evans

[57] ABSTRACT

A method for developing electrostatic latent images on the surface of a photosensitive drum uses a one-component developer. The developer has an amount of triboelectric charge within the range of about 30-100 μm c/m², and a true specific gravity of at least about 1.2. The developer can be sufficiently moved to the electrostatic latent image so as to prevent fogging of developed images and to consistently obtain developed images of good quality.

3 Claims, 3 Drawing Sheets

METHOD FOR DEVELOPING AN ELECTROSTATIC LATENT IMAGE

BACKGROUND OF THE INVENTION

1. Field of the Invention

The present invention relates to a method for developing an electrostatic latent image formed on the surface of a photosensitive body, such as a photoconductive drum used for electrophothographic devices and laser printers with one-component developers.

2. Description of the Related Art

It is known to use one-component developers and two-component developers for developing latent electrostatic images.

A two-component developer includes toner particles which actually form a visible image from the latent image and carrier particles for properly charging the toner. In such two-component developers, the mixing ratio of toner to carrier, i.e., the toner concentration, must be kept constant. However, it is difficult to maintain toner concentration constant. A one-component developer has an advantage in that concentration control is not necessary, since toner is the only component of the developer.

There have been proposed developing methods employing the one-component type toner containing no magnetic powder, which is used in the conventional two-component type developing method, but offering a high specific resistance.

The aforesaid methods include those disclosed in U.S. Pat. Nos. 2,895,847 and 3,152,012 and Japanese Laid open Application Nos. 9475/66, 2877/70 and 3624/79, using the touch-down, impression or jumping method.

Use of the toner employed in the two-component type developing method for the one-component developing method still poses the following problems:

In the first place, the amount of the triboelectric charge generated is insufficient when the above method is used. In the one-component developing method generally, the toner relative to a toner conveyer must be charged efficientry for an extremely short time and obtain a charge amount (e.g., between about $-0.5$ $-15$ $\mu C/g$ when a selenium photosensitive drum is used) sufficient to convert an electrostatic latent image formed on a photosensitive drum or dielectric into a visible image in a non-contact state. However, the problem is that the toner cannot be charged enough to carry out the aforesaid image visualization by friction between the toner used in the conventional two-component type developing method and the toner conveyer. In other words, although time is consumed to charge the toner and the carrier to the extent that the charge amount is sufficient to implement image visualization in the conventional two-component developing method, the triboelectric charge time consumed to charge the toner and the toner conveyer by friction in the one-component developing method is too short to provide the charge amount necessary for the image visualization.

Secondly, the surface of a toner conveyer must be covered uniformaly with an extremely thin toner layer, but such a thin layer is impossible to form with the toner employed in the two-component type developing method.

Thirdly, since the major part of the toner is composed of resin, a great percentage of resin exists on the surface of the toner. A pigment in general is negatively charged and, particularly in the case of carbon black, it is negatively charged. The resin is negatively charged by the friction with the elastic blade. This causes an opposite polarity to be produced by the charge generated on the surface of the toner particle between other toner particles; between the toner and the toner conveyer; and between the toner and the elastic blade.

Fourthly, there is the problem that when the toner is transferred from the toner conveyer onto the electrostatic latent image, toner is caused to reciprocate between the toner conveyer and the photosensitive drum. Although a visible image will be formed, if the specific gravity of the toner is low, unnecessary toner will be scattered on the photosensitive drum and will lead to fogging.

Consequently, problems such as development of fog and the scattering of toner may occur. The aforesaid problems frequently occur, particularly when a large volume of documents are copied. Therefore, the conventional one-component type toner is impractical for use in a copying machine.

SUMMARY OF THE INVENTION

Accordingly it is an object of the present invention to provide a developing method which overcomes the aforementioned problems. More specifically, it is an object of the invention to provide a developing method that overcomes the fogging problem.

It is a further object of the present invention to provide a developing method wherein a charged toner is used whose frictonal static charge quantity distribution is not only sharp, but also uniform, without causing the development of fog and the scattering of toner on the periphery of a latent image edge, so as to consistently convert the electrostatic latent image into a visible image of good quality.

In accordance with the present invention, the foregoing objects, among others, are achieved by providing a method for developing an electrostatic latent image comprising the steps of forming an electrostatic latent image on the surface of an image holding member; and supplying one-component developer particles to the electrostatic latent image from a developer transferring member spaced from the image holding member, the one-component developer having an amount of frictional static charge within the range of about 30–100 $\mu c/m^2$ and a true specific gravity of at least about 1.2.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to thoe skilled in the art from this detailed description.

BRIEF DESCRIPTION OF THE DRAWINGS

A more complete appreciation of the present invention and many of it's attendant advantages will be readily obtained by reference to the following detailed description considered in connection with the accompanying drawings in which.

DETAILED DESCRIPTION OF THE PREFERRED EMBODIMENTS

Figure 1:
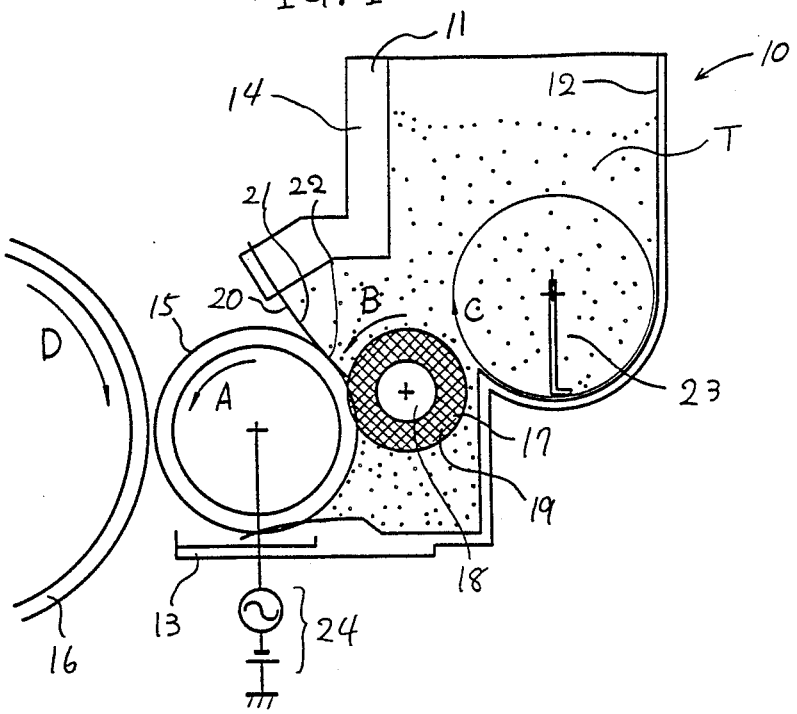
FIG. 1 is a schematic sectional view of the developing apparatus in which the developing method according to the present invention can be used.

FIG. 1 is a schematic sectional view of a developing apparatus in which the developing method according to the present invention can be used.

Referring now to FIG. 1, developing apparatus 10 has a housing 11 constituted by a back frame 12, bottom frame 13, and front frame 14. Housing 11 stores non-magnetic developer T. In housing 11, developing roller 15 conveys developer from housing 11 towards photosensitive drum 16 on which a latent image is formed. Developing roller 15 is interposed between bottom frame 13 and front frame 14. Developing roller 15 is arranged adjacent to photosensitive drum 16, and is rotatable in a direction indicated by arrow A in FIG. 1.

Therefore, a portion of developing roller 15 is located inside housing 11 to be in contact with developer T, and the other portion on the side of drum 16 is exposed to the outside between bottom frame 13 and front frame 14.

Developing roller 15 has an aluminium sleeve. The outer surface of the sleeve is sand blasted, and has a nickel layer electroplated thereon. The surface roughness of the aluminum sleeve after plating is about 1 μm.

Developer supplying roller 17 for supplying developer T to developing roller 15 while charging developer T is arranged adjacent to bottom frame 13 in housing 11. Roller 17 is rotatable in a direction indicated by arrow B in FIG. 1 and is in contact with roller 15.

Developer supplying roller 17 is constituted by a metal shaft 18 having conductive rubber 19 coated thereon. Conductive rubber material 19 can be prepared by mixing carbon or metal powder in neoprene rubber.

The proximal end portion 20 of an elastic blade 21 forms a thin film layer of developer on developing roller 15 and charges it. Blade 21 is mounted on the lower end portion of front frame 14. The free end portion 22 of elastic blade 21 is urged against developing roller 15 at a position above a contacting point between rollers 17 and 15.

The elastic blade 21 is pressed toward developing roller 15 with a pressure of about 20 to 500 g/cm.

Stirring plate 23 for stirring the developer inside housing 11 is rotatable in a direction indicated by arrow C in FIG. 1 and is arranged at substantially the center of housing 11.

The superimposed voltage power source 24 is connected to developing roller 15. The base of photosensitive drum 16 is grounded.

Developer supplying roller 17 is rotated in a direction opposite to arrow A at a contacting point with developing roller 15. Roller 17 moves toner therearound by a frictional force with its outer peripheral surface, so as to triboelectrically charge the developer particles. In this particular embodiment, the developer is charged to be positive (+). Roller 17 is grounded, and so has a relatively negative (−) charge. Therefore, the developer becomes attached to roller 17 by an electrostatic force, and is moved upon rotation of roller 17. Since the attached developer particles are moved with the roller 17 upon rotation of roller 17, developer particles can be sufficiently triboelectically charged together with the surrounding developer particles.

The developer particles which become attached to roller 17 and are sufficiently charged are rubbed onto roller 15 at the contacting point between rollers 17 and 15. Upon this rubbing, the developer becomes attached to roller 15. The toner attached to roller 15 is pressed by blade 21 and is further triboelectircally charged, thus forming a uniform thin layer.

Roller 15 is rotated in the direction indicated by arrow A and conveys the developer layer to a position facing photosensitive drum 16. A developing bias is established between roller 15 and drum 16 by power source 24, so that the developer particles attached to roller 15 fly to drum 16, thus developing a latent image formed thereon.

The true specific gravity of the toner used in the present invention is at least 1.2. In this invention, it is desirable that the triboelectric charge of the toner should be within the range of 30 $\mu c/m^2$–100 $\mu c/m^2$. If the triboelectric charge of the toner is less than 30 $\mu c/m^2$, the toner cannot be held sufficiently on the developing roller. As a result, the developed image cannot have sufficient copy density.

Conversely, if the triboelectric charge of the toner is more than 100 $\mu c/m^2$, the toner will be held too firmly on the developing roller, and the toner cannot move to the photosensitive drum from the developing roller. Thus, a developed image cannot have sufficient copy density. If the true specific gravity of the toner is less than 1.2, a developed image exhibits fogging. This is because the toner moves to portions outside the latent image on the photosensitive drum.

The value of the triboelectric charge in relation to the surface area is obtained as follows. For the developing agent, 3% by weight of toner is mixed with iron oxide powder (TEFV-200/300, manufactured by Nippon Teppunsha) as the carrier. This developing agent is blown onto a 400 mesh conductive mesh with $N_2$ gas at a pressure of 1 $kg/cm^2$, and the triboelectric charge is measured with a blow-off measurement device (Trade name: TB-200, manufactured by Toshiba Chemicals Co.) after 1 minute. This charge of the developing agent is divided by the surface area of the toner, obtained by calculation from the particle size distribution. The surface area is found by measuring the particle diameter with a counter (COULTER COUNTER MODEL TAII). This gives the value of the triboelectric charge in relation to the surface area.

Also, for the true specific gravity of toner, the value was obtained by dividing the weight of a sample by the volume of the sample, which was obtained by the well-known inert gas replacement method.

In a preferred embodiment of the present invention, the toner contains a resin whose glass transition point is over 50° C. and whose softening point is between 110° C.–160° C. If the glass transition point is less than about 50° C., the storage stability tends to reduce. If the softening point is less than about 110° C., off-setting will be produced. If the softening point exceeds about 160° C., the toner will not be fixed. Therefore, as the toner in the present invention, one with a triboelectric charge of 30–100 $\mu c/m^2$ in used. For the resin used in the toner, any styrene - (meth) acryl - aminomethacryl copolymer, which has a glass transition point of at least 50° C. and a softening point of 110°–160° C. is suitable As the acryl components or methacryl components in the above copolymer, the hitherto known acrylic acid and its derivatives together with methacrylic acid and its derivatives such as acrylic acid and acrylic acid esters such as methylacrylate, ethylacrylate, propylacrylate, isopropylacrylate, lutylacrylate, isobutylacrylate, pentyl - acrylate, hexylacrylate, heptylacrylate, and octylaceylate, together with methacrylic acid and metacrylic acid esters as methylmethacrylate, ethlmethacrylate, propylmethacrylate, isopropylmethacrylate, butyl - methacrylate, isobutylmethacrylate, pentylmethacrylate, hexylmethacrylate, heptylmethacrylate and octylmethacrylate, may be used.

As the monomer possessing an amino radical used in the above copolymer, any methacrylic acid derivative shown by the following general formula is suitable.

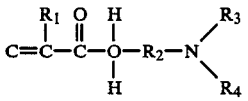

(Wherein $R_1$, $R_2$, $R_3$ and $R_4$ are alkyl bases with carbon numbers 1–8)

As the monomer possessing an amino radical shown by the above general formula, such examples as
2-dimethylamino-2-methylpropylmethacrylate,
2-dimethylamino-2-ethylbutyl-methacrylate,
2-dimethylamino-2-propylhexylmethacrylate,
2-diethylamino-2-methylpropylmethacrylate,
2-diethylamino-2-ethylbutylmethacrylate and
2-diethylamino-2-propylhexylmethacrylate
can be cited.

As the polymerization initiator for copolymerizing the monomer possessing an amino radical with the styrene-acryl copolymer or the styrene-methacryl copolymer, a nitrile group initiator, represented by such substances as azobis (isobutylonitrile) and azobis2-(2-naphthyl) propylonitrile can be used.

Moreover, as the coloring agent used in this invention, such publicly known coloring agents as carbon black, fast yellow-G, bonzidine yellow, pigment yellow, indofast orange, ilgadine red, carmine FB, permanent bordeaux FRR, pigment orange R, lysol red 2G, lake red, rhodamine FB, rhodamine B lake, copper phthalocyanine blue, pigment blue, brilliand green B, copper phthalocyanine green and quinacridone
can be used.

Furthermore, as the addition agents with true specific gravity of at least 1.2 which are used in this invention.

metal powders such as iron powder, copper powder, aluminium powder, gold powder and mineral powder, or inorganic oxides such as aluminium oxide, aluminium hydroxide, barium carbonate, barium nitrate, calcium carbonate, copper sulphate, iron sulphate, magnesium carbonate, magnesium sulphate, nickel oxide, zinc oxide and silicon oxide, or magnetic powders such as triiron tetroxide, or alloys such as brass, bronze and stainless steel, or glass, can be cited. These may be added to an extent in which they do not reduce the properties of the toner.

In addition, wax may also be added, as necessary, in order to improve the anti-offset property, and polyamine group or nigromine group charge control agents may be added, as necessary, to control the frictional static charge.

Furthermore, hydrophobic colloidal particles of the same polarity as the toner, such as colloidal silica, may be added as necessary, to an extent which does not affect the toner charge, for instance 0.05–5 parts by weight per 100 parts by weight of of toner, in order to improve the fluidity and anti-coagulability of the toner.

In the following example, "parts" signifies "parts by weight".

EXAMPLE 1

A mixture comprising 82 parts of styrene-n-lutylmethacrylate-diethylaminoelhylmethacrylate copolymer (Tg: 72.0° C., softening point 122° C. (R&B method), number-average molecular weight 9.300, polymerization-average molecular weight 181,000, electrostatic charge 78.5 $\mu c/m^2$), 4 parts of carbon black, 3 parts of wax, 10 parts of barium sulphate (specific gravity 4.499) and 1 part of charge control agent (Trade name: AFP-B, manufactured by Orient Chemicals Co.) was well blended in a ball mill for about 2 hours. Then, the mixture was well kneaded by a pressure kneader for 1 hour. The kneaded product was left to cool, crushed by a hammer mill and pulverized by a jet mill. It was then classified by a pneumatic classifier to obtain fine developer with particle diameter 5–25 $\mu m$.

Then, a mixture comprising 100 parts of this developer, 0.5 parts of colloidal fine particle (Trade name: RP-130, manufactured by Nippon Aerojirusha) was well mixed on a ball mill, so that colloidal fine particles adhered to surfaces of the developer particles. A non-magnetic one-component toner which had a 50% weight average particle diameter of 12.6 $\mu m$ and a positive charging property was obtained.

The triboelectric charge of this toner measured by the blowoff method was 53.4 $\mu c/m^2$. The true specific gravity of the toner was 1.26.

The developer was tested on a commercially available plain paper copier (Trade name: BD-3110, manufactured by Toshiba) which was remodeled into a copier using an OPC photosensitive drum. Supplying the toner by the developing apparatus shown in FIG. 1, developing was carried out at normal temperature and normal humidity (23° C., 60% RH), and sharp pictures were obtained without any fogging in developing.

EXAMPLE 2

The same process as that in Example 1 was executed, except that ferric oxide (specific gravity 5.0) in place of barium sulphate was used.

The triboelectric charge of this toner measured by the blow-off method was 73.8 $\mu c/m^2$. The true specific gravity of the toner was 1.42.

A clear image without any fogging of the latent image was obtained.

EXAMPLE 3

The same process as that in Example 1 was executed, except that zinc oxide (specific gravity 5.6) in place of barium sulphate was used.

The triboelectric charge of this toner measured by the blow-off method was 64.2 $\mu c/m^2$. The true specific gravity of the toner was 1.55.

A clear image without any fogging of the latent image was obtained.

EXAMPLE 4

The same process as that in Example 1 was executed, except that aluminium powder (specific gravity 2.69) in place of barium sulphate was used.

The triboelectric charge of this toner measured by the blow-off method was 45.3 $\mu c/m^2$. The true specific gravity of the toner was 1.26.

A clear image without any fogging of the latent image was obtained.

COMPARATIVE EXAMPLE 1

The same process as that in Example 1 was executed, except that barium sulphate was not added.

The triboelectric charge of this toner measured by the blow-off method was 58.2 $\mu c/m^2$. The true specific gravity of the toner was 1.112.

COMPARATIVE EXAMPLE 2

The same process as that in Example 1 was executed, except that copier powder (specific gravity 8.93) in place of barium sulphate was used, and a charge control agent was not added.

The triboelectric charge of this toner measured by the blow-off method was plus 23.5 $\mu c/m^2$. The true specific gravity of the toner was 1.88.

COMPARATIVE EXAMPLE 3

The same process as that in Example 1 was executed, except that ferric oxide (specific gravity 5.0) in place of barium sulphate was used, and a charge control agent was added in an amount greater than in Example 1.

The triboelectric charge of this toner measured by the blow-off method was 132 $\mu c/m^2$. The true specific gravity of the toner was 1.42.

The various examples are summarized in the table which appears on the following chart.

Figure 2:
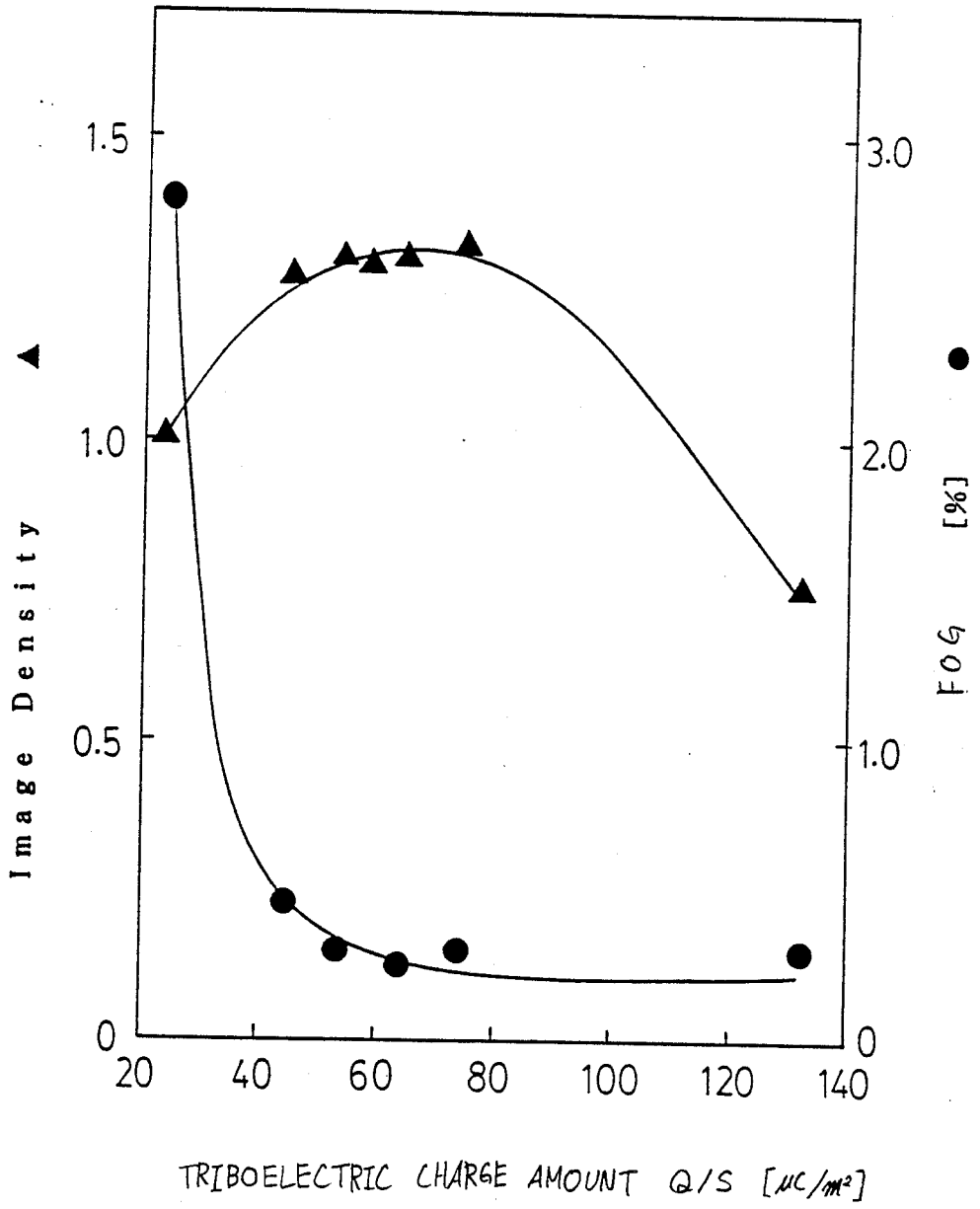
FIG. 2 is a graph showing the relationship of the triboelectric charge amount of the toner to the image density and to the percentage of fogging.
Figure 3:
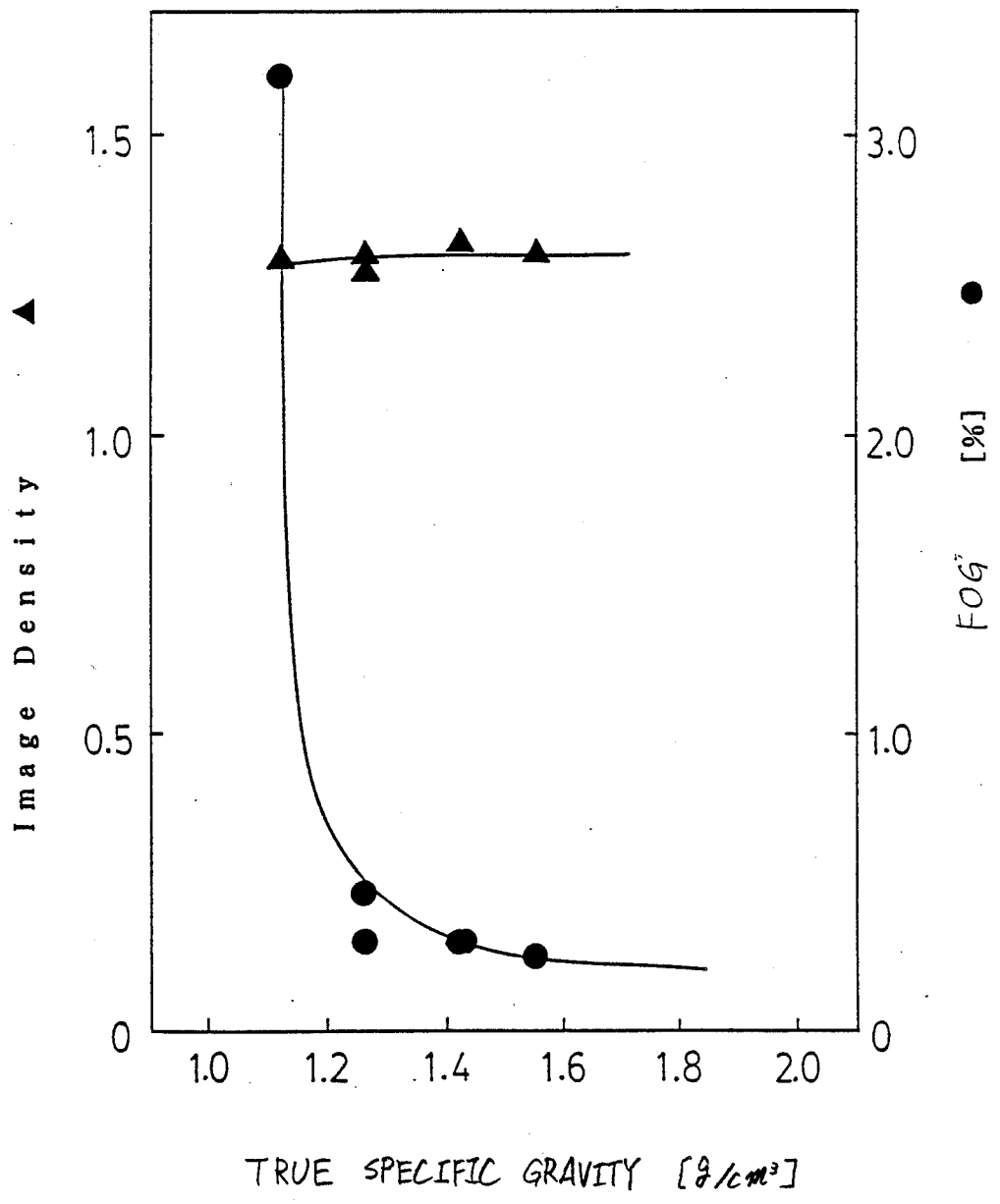
FIG. 3 is a graph showing the relationship of the true specific gravity of the toner to the image density and to the percentage of fogging.

The relationships between the image density, the fog and the triboelectric charge amount of the toner shown in FIG. 2 were found. The relationships between the image density, the fog, and the true specific gravity of the toner shown in FIG. 3 were found.

While this invention has been described in connection with what is presently considered to the most practical and preferred embodiment, it is to be understood that the invention is not limited to the disclosed embodiment, but, on the contrary, the claims are intended to cover various modifications and equivalent arrangements included within the spirit and scope of the appended claims.

What is claimed is:

1. A method for developing an electrostatic latent image, comprising the steps of:

forming an electrostatic latent image on the surface of an image holding member; and supplying one-component developer particles to said electrostatic latent image from a developer transferring member spaced from the image holding member, said one-component developer having an amount of triboelectric charge within the range of about 30–100 $\mu c/m^2$ and a true specific gravity of at least about 1.2.

2. A method according to claim 1, wherein the step of supplying includes the step of selecting a developer having a 50% weight average particle diameter between about 5–25 $\mu m$.

3. A method according to claim 1, wherein the step of supplying includes the step of adding about 0.05–2.0 parts by weight of colloidal fine particles to the developer.

* * * * *

| | addition agent | | toner | | | | |
|---|---|---|---|---|---|---|---|
| Example | component | specific gravity | true specific gravity | charge amount | Image density | FOG (%) | Remarks |
| Example 1 | barium sulphate | 4.499 | 1.26 | 53.4 $\mu c/m^2$ | 1.32 | 0.20 | |
| Example 2 | triiron tetroxide | 5.0 | 1.42 | 73.8 $\mu c/m^2$ | 1.33 | 0.30 | |
| Example 3 | zinc oxide | 5.6 | 1.55 | 64.2 $\mu c/m^2$ | 1.31 | 0.25 | |
| Example 4 | aluminium powder | 2.69 | 1.26 | 45.3 $\mu c/m^2$ | 1.28 | 0.46 | |
| COMPARATIVE Example 1 | nothing | | 1.12 | 58.2 $\mu c/m^2$ | 1.30 | 3.20 | |
| COMPARATIVE Example 2 | copper powder | 8.93 | 1.88 | 23.5 $\mu c/m^2$ | 1.01 | 2.80 | not added charge control agent |
| COMPARATIVE Example 3 | ferric oxide | 5.0 | 1.42 | 132 $\mu c/m^2$ | 0.76 | 0.30 | added a large of charge control agent |